US005256516A

United States Patent [19]

Winnik et al.

[11] Patent Number: 5,256,516

[45] Date of Patent: Oct. 26, 1993

[54] TONER COMPOSITIONS WITH DENDRIMER CHARGE ENHANCING ADDITIVES

[75] Inventors: Francoise M. Winnik, Toronto; James M. Duff, Mississauga; Guerino G. Sacripante, Oakville; Anthony R. Davidson, Agincourt, all of Canada

[73] Assignee: Xerox Corporation, Stamford, Conn.

[21] Appl. No.: 922,420

[22] Filed: Jul. 31, 1992

[51] Int. Cl.[5] ..... G03G 9/057; G03G 9/093

[52] U.S. Cl. ..... 430/110; 430/111; 430/138

[58] Field of Search ..... 430/110, 126, 138, 111

[56] References Cited

U.S. PATENT DOCUMENTS 4,338,390 7/1982 Lu ..... 430/106
4,507,446 3/1985 Tomalia et al. ..... 528/310
4,558,120 12/1985 Tomalia et al. ..... 528/331
4,568,737 2/1986 Tomalia et al. ..... 528/310
4,587,329 5/1986 Tomalia et al. ..... 528/310
4,631,337 12/1986 Tomalia et al. ..... 528/391
4,694,064 9/1987 Tomalia et al. ..... 528/332
4,857,599 8/1989 Tomalia et al. ..... 528/310
4,937,157 6/1990 Haack et al. ..... 430/110
4,938,885 7/1990 Migdal ..... 252/51.5
5,024,915 6/1991 Sato et al. ..... 430/110
5,098,475 3/1992 Winnik et al. ..... 106/22
5,120,361 1/1882 Winnik et al. ..... 106/22

*Primary Examiner*—Christopher Rodee
*Attorney, Agent, or Firm*—E. O. Palazzo

[57] ABSTRACT

A dry toner composition comprised of resin particles, pigment particles, and a dendrimer charge enhancing additive.

4 Claims, No Drawings

TONER COMPOSITIONS WITH DENDRIMER CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a positive charge or a negative charge to the toner resin particles and enable toners with rapid admix characteristics. In one embodiment, there are provided in accordance with the present invention toner compositions comprised of resin particles, pigment particles, and dendrimers as illustrated, for example, in U.S. Pat. No. 5,098,475 and U.S. Pat. No. 5,120,361, the disclosures of which are totally incorporated herein by reference. In these patents, there are illustrated inks with dendrimers, and more specifically, in U.S. Pat. No. 5,098,475, the disclosure of which is totally incorporated herein by reference, there is disclosed an ink composition which comprises an aqueous liquid vehicle and a colored dendrimer, or dendricolorant obtained by attaching a reactive dye or dyes to commercially available amino terminated dendrimers, that is for example a dendrimer having an amine group like $NH_2$ attached to the end of the arm farthest removed in distance from the core, which dendrimers can be of the first, second, third, or n-th generation, wherein n is a number of preferably less than 9, and more specifically is a number of from about 1 to about 8, and wherein the attachment reaction can be accomplished at room temperature in water. The resulting dispersion of colored dendrimers can be formulated into an ink by the addition, for example, of a cosolvent comprised of water and a glycol, like diethylene glycol, thereby improving latency, which is the maximum time period, for example less than one hour, and from about 1 to about 10 minutes, over which an uncapped ink jet printhead can remain idle before noticeable deterioration of its jetting performances, and this addition can improve ink drying time, that is the time needed for an ink jet print to dry to an extent such that it will not smear or offset upon handling or when placed in contact with another sheet of paper, which drying time can, for example, be less than one minute, or more specifically from about 10 to about 30 seconds.

The aforementioned additives in embodiments of the present invention enable, for example, toners with rapid admix of less than about 60 seconds, extended developer life, stable electrical properties, excellent flow characteristics, and high image print quality with substantially no background deposits. Also, the dendrimers can be incorporated into the toner in small effective amounts, such as 0.01 weight percent of the toner, and the dendrimers are nontoxic and environmentally safe as compared to, for example, charge additives of metal complexes like chromium salicylates which are considered unsafe environmentally. The aforementioned toner compositions usually contain pigment particles comprised of, for example, carbon black, magnetites, or mixtures thereof, cyan, magenta, yellow, blue, green, red or brown components, or mixtures thereof providing for the development and generation of black and/or colored images. The toner compositions of the present invention in embodiments thereof possess excellent admix characteristics as indicated herein, and maintain their triboelectric charging characteristics for an extended number of imaging cycles. The toner and developer compositions of the present invention can be selected for electrophotographic, especially xerographic imaging and printing processes, including color processes.

Developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds $NR_4X$ with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; and U.S. Pat. No. 4,221,856 which discloses electrophotographic toners containing resin compatible quaternary ammonium compounds in which at least two R substituents are hydrocarbons having from 8 to about 22 carbon atoms, and each other R is a hydrogen or hydrocarbon radical with from 1 to about 8 carbon atoms, and A is an anion. There are also described in U.S. Pat. No. 2,986,521 reversal developer compositions comprised of toner resin particles coated with finely divided colloidal silica. Also, there is illustrated in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles; and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430; 4,560,635 which illustrates a toner with a distearyl dimethyl ammonium methyl sulfate charge additive; and U.S. Pat. No. 4,490,455 which discloses toners with, for example, amine salt charge enhancing additives, reference the Abstract of the Disclosure for example, and wherein the charge additive includes those derived from aromatic substituted sulfonic acids, such as benzene sulfonic acid, and the like, see column 3, beginning at line 33; and also known are bisulfate charge additives. Also, toners with dendrimers are particularly advantageous in that the toners can be prepared by in situ methods since, for example, the dendrimer can be applied as aqueous solutions to the toner suspension in water prior to toner drying. Many of the known charge additives are not as soluble in water as the dendrimers and/or they do not exhibit the same affinity for the toner surface in an aqueous environment, thus leading to nonuniform surface coverage and image resolution problems.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 complex system for developing electrostatic images with a toner which contains a metal complex represented by the formula in column 2, for example, and wherein ME, the metal, can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Illustrated in U.S. Pat. No. 4,937,157, the disclosure of which is totally incorporated herein by reference, are toner compositions comprised of resin, pigment, or dye, and tetraalkyl sulfates, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl substituents contain from about 10 to about 30 carbon atoms, and more preferably dialkyl radicals with from about 14 to about 22 carbon atoms, and the like. The aforementioned charge additives can be incorporated into the toner or may be present on the toner surface.

Although many charge enhancing additives are known, there continues to be a need for toners with additives, which toners possess many of the advantages illustrated herein. Additionally, there is a need for positive or negative charge enhancing additives which are useful for incorporation into black, and/or colored toner compositions. Moreover, there is a need for colored toner compositions containing nontoxic dendrimer charge enhancing additives therein, or on the toner surface. There is also a need for toner compositions which toners in embodiments thereof possess acceptable substantially stable triboelectric charging characteristics, and excellent admixing properties. Moreover, there continues to be a need for positively or negatively charged toner and developer compositions. Further, there is a need for toners with nontoxic legally disposable charge enhancing additives which can be easily and permanently dispersed into toner resin particles. There also is a need for positively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which have the desired triboelectric charge level, for example, from about 10 to about 40 microcoulombs per gram, and preferably from about 5 to about 25 microcoulombs per gram, and admix charging rates of from about 5 to about 60 seconds, and preferably from about 15 to about 30 seconds as determined by the charge spectrograph, preferably for example at low concentrations, that is for example less than 1 percent, and preferably less than about 0.1 percent of the charge enhancing additive of the present invention.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing dendrimer charge enhancing additives.

In yet another object of the present invention there are provided positively charged toner compositions containing on the surface thereof nontoxic dendrimer, especially first generation dendrimers, charge enhancing additives.

Another object of the present invention resides in providing toner compositions with mixtures of charge enhancing additives wherein one of the additives is a dendrimer, and the others can be selected from known charge additives as mentioned herein in, for example, the U.S. patents recited, including quaternary ammonium hydrogen bisulfate, especially trialkyl ammonium hydrogen bisulfate, a tetraalkyl ammonium sulfonate, such as dimethyl distearyl ammonium sulfonate, distearyl dimethyl ammonium methyl sulfate, and the like.

Also, in another object of the present invention there are provided developer compositions with positively charged toner particles, carrier particles, and the enhancing additives illustrated herein, or mixtures of these additives with other known charge enhancing additives.

In yet a further object of the present invention there are provided humidity insensitive, from about, for example, 20 to 80 percent relative humidity at temperatures of from 60° to 80° F. as determined in a relative humidity testing chamber, positively charged toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about 10 to about 40 microcoulombs per gram.

Additionally, in a further object of the present invention there are provided magnetic toner compositions, and charged colored toner compositions containing therein, or thereon a dendrimer charge enhancing additive.

Furthermore, in yet another object of the present invention there are provided toner and developer compositions that are useful in a variety of electrostatic imaging and printing processes, including color xerography, and wherein the admix charging times are less than 60 seconds.

In another object of the present invention there can be provided, it is believed, thermally stable charge enhancing additives, that is for example additives which do not decompose at high temperatures, for example, of from about 130° to about 160° C.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, pigment particles, and dendrimer charge enhancing additives. More specifically, the present invention in embodiments is directed to dry toner compositions comprised of resin, pigment, or dye, and a dendrimer, especially a first generation dendrimer charge additive. The aforementioned charge additives can be incorporated into the toner, may be present on the toner surface or may be present on toner surface additives such as colloidal silica particles. Advantages of rapid admix, appropriate triboelectric characteristics, and the like are achieved with many of the aforementioned toners of the present invention. Also, the toners of the present invention may contain mixtures of the aforementioned charge additive with other charge additives such as distearyl dimethyl ammonium methylsulfate, the bisulfates, and charge additives of the copending application U.S. Ser. No. 396,497 and U.S. Pat. Nos. 4,937,157 and 4,904,762, the charge additives of the patents mentioned herein; and the like, which mixtures may contain from about 0.01 to about 15 percent by weight of the charge enhancing additive of the present invention, and from about 0.01 to about 15 percent of a second charge enhancing additive. Other amounts of mixtures may also be selected in embodiments of the present invention.

In another embodiment of the present invention there is provided subsequent to known micronization and classification to enable toner particles with an average diameter of from about 5 to about 20 microns comprised of resin particles, pigment particles, and the dendrimer charge enhancing additive.

In embodiments, the present invention is directed to an encapsulated toner composition comprised of a core comprised of a resin, pigment particles, a polymer shell, and thereover coated with a dendrimer charge enhancing additive; and an in situ toner composition comprised of a core comprised of a resin, pigment particles, optionally a surfactant coating, and thereover a coating of a dendrimer charge enhancing additive.

The toner compositions of the present invention can be prepared by a number of known methods such as admixing and heating resin particles such as styrene butadiene copolymers, pigment particles such as magnetite, carbon black, like REGAL 330®, or mixtures thereof, and preferably from about 0.01 percent to about 1 weight percent of the dendrimer charge enhancing additive, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Additionally, the toner composition of the present invention can be prepared by dispersing a toner comprised of resin particles such as styrene butadiene copolymers, pigment particles such as magnetite, and carbon black, like REGAL 330®, in an aqueous solution containing a surfactant such as methyl cellulose of from about 0.1 to about 1 percent by weight of water and adding thereto from about 0.01 percent to about 5 weight percent of the dendrimer charge enhancing additive, or mixtures of charge additives, and preferably from about 0.05 to about 1 percent by weight, followed by washing the toner by centrifugation, and drying the toner utilizing a spray dryer or fluidized bed dryer.

In addition to the aforementioned preparation the toner particles utilized can be prepared by a number of in situ methods in which mixtures of polymers and/or monomers and additives such as pigments are converted into toners by wet chemical processing, such as for example known encapsulation processes as disclosed in U.S. Pat. Nos. 4,954,412; 5,080,986 and 5,035,970, the disclosures of which are totally incorporated herein by reference, by microsuspension processes, such as those disclosed in U.S. Pat. No. 4,071,670, by spray drying as disclosed in U.S. Pat. Nos. 3,910,846 and 4,161,454, by controlled precipitation or coacervation as disclosed in U.S. Pat. No. 4,097,454, by monomer swelling followed by polymerization of small seed particles, as disclosed in U.S. Pat. No. 4,077,804 and by controlled coagulation of small particles in the presence of pigments, as disclosed in U.S. Pat. Nos. 4,797,339; 4,996,127; 4,983,488 and 5,066,560, the disclosures of which are totally incorporated herein by reference, and wherein the dendrimer charge enhancing additive, or mixtures of charge additives, are added in an amount of from about 0.01 to about 1 percent by weight of toner prior to the washing and drying steps.

In addition to the aforementioned preparations of toner composition, the toner particles utilized can be prepared by a number of dry blending methods, such as for example ball milling, wherein the dendrimer charge enhancing additive, or mixtures of charge additives, are added in amounts of from about 0.01 to about 5 percent by weight of toner prior to use in a developer system.

Illustrative examples of suitable toner resins selected for the toner and developer compositions of the present invention include polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Examples of specific toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers may be selected.

As one toner resin there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES ®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 6,000 such as polyethylene, polypropylene, and paraffin waxes can be included in, or on the toner compositions as fuser roll release agents. Examples of other resins include the polyesters obtained by reactive extrusion as illustrated in copending patent applications U.S. Ser. No. 814,641, and U.S. Ser. No. 814,782, the disclosures of which are totally incorporated herein by reference.

Examples of resin particles also include those as obtained by in situ processes, such as disclosed, for example, in U.S. Pat. No. 4,626,489, the disclosure of which is incorporated herein by reference, and British Patent 1,538,787 wherein similar processes are disclosed for colored encapsulated toners wherein both the core resin and shell materials are prepared by suspension polymerization techniques. U.S. Pat. No. 4,565,764 discloses a colored microcapsule toner comprised of a colored core encapsulated by two resin shells with the inner shell having an affinity for both the core and the outer shell materials; U.S. Pat. No. 4,727,011 discloses a process for preparing encapsulated toners which involves a shell forming interfacial polycondensation and a core binder forming free radical polymerization; and U.S. Pat. No. 4,708,924 discloses the use of a mixture of two polymers, one having a glass transition temperature in the range of −90° C. to 5° C., and the other having a softening temperature in the range of 25° C. to 180° C., as the core binders for a pressure fixable encapsulated toner. Other representative United States patents are U.S. Pat. Nos. 4,339,518 and 4,016,099, which discloses methods of forming encapsulated toner particles and wherein there are selected organic polymers including homopolymers and copolymers such as vinylidene fluoride, tetrafluoroethylene, chlorotrifluoroethylene, and the like; 4,520,091 discloses an encapsulated toner with a core which comprises a colorant, a dissolving solvent, a nondissolving liquid and a polymer, and may include additives such as fluorine containing resin; and 4,590,142 relating to capsule toners wherein additives such as polytetrafluoroethylenes are selected as lubricating components. Also, in U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Illustrated in U.S. Pat. No. 4,758,506, the disclosure of which is totally incorporated herein by reference, are single component cold pressure fixable toner compositions, wherein the shell selected can be prepared by an interfacial polymerization process. Further, in U.S. Pat. No. 5,043,240, the disclosure of which is totally incorporated herein by reference, there are illustrated encapsulated toners with a core comprised of a polymer binder, pigment or dye, and thereover a polymeric shell, which contains a soft and flexible component, permitting, for example, proper packing of shell materials resulting in the formation of a high density shell structure, which can effectively contain the core binder and prevent its loss through diffusion and leaching process.

The resin particles are present in a sufficient, but effective amount, for example from about 70 to about 90 weight percent. Thus, when 0.1 percent by weight of the charge enhancing additive is present, and 10 percent by weight of pigment or colorant, such as carbon black, is contained therein, about 89.9 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.1 weight percent to about 1 weight percent.

Typical well known suitable pigments or dyes can be selected as the colorant for the toner particles including, for example, carbon black, like REGAL 330 ®, Vulcan carbon blacks, and the like available from Columbian Chemicals and Cabot Corporation, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles may be selected in embodiments.

When the pigment particles are comprised of magnetites, thereby enabling single component toners in some instances, which magnetites are a mixture of iron oxides ($FeO.Fe_2O_3$) including those commercially available as MAPICO BLACK TM, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK TM, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas such as AEROSIL ®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSIL ® can be surface treated with the charge additives of the present invention illustrated herein in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In embodiments, these colored pigment particles are present in the toner composition in an amount of from about 2 percent by weight to about 15 percent by weight calculated on the weight of the toner resin particles.

The dendrimers selected for the toners of the present invention are, for example, illustrated in the documents mentioned herein. Dendrimers are known, and can be considered radially symmetrical molecules of a STARBURST TM topology comprised of an initiator core, such as nitrogen, ethylenediimine, silicon, and the like, interior layers attached to the core and comprised of, for example, three or four arms, each arm being composed of repeating units with the number of repeating units in each arm being considered the generation of the dendrimer, and terminal functional groups functionality, such as for example a primary amine attached to the outermost generation, which dendrimers are illustrated, for example, in U.S. Pat. Nos. 4,507,466; 4,631,337; 4,558,120; 4,568,737 and 4,587,329; and in D. A. Tomalia, A. M. Naylor, and W. A. Goddard III, *Angewandte Chemie, Int.* Ed. Engl. 29, 138 (1990), the disclosures of which are totally incorporated herein by reference. The size and shape of the STARBURST TM dendrimer molecule and the functional groups present in the dendrimer molecule can be controlled by the choice of the initiator core, the number of generations, and the choice of repeating units employed at each generation. The choice of the dendrimer components can affect the properties of the dendrimers. The initiator core type can affect the dendrimer shape producing, for example, spheroid-shaped dendrimers, cylindrical- or rod-shaped dendrimers, or ellipsoid-shaped dendrimers. Sequential building of generations determines the dimensions of the dendrimers and the nature of its interior. Examples of suitable core materials include ammonia, polyfunctional alcohols, such as pentaerythritol or tris-(hydroxymethyl)ethane, 1,1,1-tris-(4'-hydroxyphenyl)-ethane, polyfunctional amines, such as ethylene diamine, linear polyethyleneimines, and the like, carbosilanes such as tetravinylsilane as described, for example, in J. Roovers, P. M. Toporowski and L-L. Zhou, *Polymer Preprints*, American Chemical Society, Division of Polymer Chemistry, 33, (1), 182 (1992), and the like; polysiloxysilanes, such as those described, for example, in L. J. Mathias and T. W. Carothers, *J. Am. Chem. Soc.*, 113, 4043 (1991), in H. Uchida, Y. Kabe, K. Yoshino, A. Kawamata, T. Tsumuraya, and S. Masamune, *J. Am. Chem. Soc.* 112, 7077 (1990), in A. Morikawa, M. Kakimoto, and Y. Imai, *Macromolecules*, 24, 3469 (1991), and the like; polyfunctional aromatic rings, such as benzoic acids, such as 3,5-diacetoxybenzoic acid, as illustrated, for example, in B. I. Voit and S. R. Turner, in *Polymer Preprints*, American Chemical Society, Division of Polymer Chemistry, 33, (1), 184 (1992); hyperbranched polyphenylenes such as those described by Y. H. Kim and O. W. Webster, in *J. Am. Chem. Soc.*, 112, 4592 (1990), hyperbranched polyarylenes, such as those described in U.S. Pat. Nos. 4,857,630 and 5,070,183 to E. I. DuPont de Nemours and Company, and the like. The chemical functionality of the repeating unit in the interior layers can include, for example, amidoamines, such as amino-ethyl acetamide, imines, such as diethylene diimine, ethers such as those obtained from materials such as, for example, 3,5-dihydroxyethyl benzyl alcohol, siloxanes, such as dimethylsiloxane, diethylsiloxane, diphenylsiloxane, and the like, carbosilanes, such as ethyl silane and the like. The terminal functionalities include, for example, amino groups, quaternary ammonium salts, phosphonium salts, hydroxyl groups, carboxylic acid groups, carboxylates, esters, amides, phosphates, sulfonates, and the like. The synthesis of dendrimers usually occurs by a divergent approach that involves the initial reaction of a monomer with the initiator core, followed by exhaustive reaction of the resulting functional groups with a difunctional compound, such as a diamine, including, for example, ethylene diamine, to afford the next generation of reactive amino groups. Repetition of the two-step procedure leads to subsequent generations. An alternate synthetic route uses a convergent growth synthesis as described in detail in C. J. Hawker and J. M. J. Fréchet, *J. Am. Chem. Soc.*, 112, 7638 (1990), the disclosure of which is totally incorporated herein by reference. Examples of dendrimers prepared by the divergent method include STARBURST® dendrimers available from the Michigan Molecular Institute, Dendrimer Microparticles available from Polysciences, Inc., in which the terminal functional groups are primary amino groups, and which range in average diameter of from about 10.8 Angstroms (first generation) to about 83.9 Angstroms (8th generation). Other dendrimers that may be selected in embodiments of the present invention include those as illustrated in U.S. Pat. Nos. 5,041,516; 4,857,599 and 4,694,064, the disclosures of which are totally incorporated herein by reference.

For the formulation of developer compositions, there are mixed with the toner particles carrier components, particularly those that are capable of triboelectrically assuming an opposite polarity to that of the toner composition. Accordingly, the carrier particles can be selected to be of a negative polarity enabling the toner particles, which are positively charged, to adhere to and surround the carrier particles. Illustrative examples of carrier particles include iron powder, steel, nickel, iron, ferrites, including copper zinc ferrites, copper zinc magnesium ferrites, available from Steward Chemicals, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from about 100 to about 175 microns thereby, for example, permitting them to possess sufficient density and inertia to avoid adherence to the electrostatic images during the development process. The carrier component can be mixed with the toner composition in various suitable combinations, however, in embodiments about 1 to 5 parts per toner to about 100 parts to about 200 parts by weight of carrier are selected.

The toner composition of the present invention can be prepared by a number of known methods including extrusion melt blending the toner resin particles, pigment particles or colorants, and the dendrimer charge enhancing additive as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be prepared, followed by the addition of surface treated colloidal silicas with charge additive. Further, other methods of preparation for the toner are as illustrated herein.

For example, the toner composition of the present invention can be prepared by in situ process, such as encapsulation process, wherein a polymerization monomer or mixture of monomers such as styrene and butyl methacrylate are mixed with pigment and free radical initiator, and a shell monomer; dispersing the said mixture in an aqueous solution containing a surfactant such as methyl cellulose, and adding thereto a second shell monomer to form the shell condensation polymer, followed by heating to polymerize the core monomer and obtaining the encapsulated toner; adding to the toner particles the dendrimer charge enhancing additive, and optionally flow aids such as AEROSIL® or colloidal silica.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference.

The toner compositions are usually jetted and classified subsequent to preparation to enable toner particles with a preferred average diameter of from about 5 to about 25 microns, and more preferably from about 8 to about 15 microns. Also, the toner compositions of the present invention preferably possess a triboelectric charge of from about 0.1 to about 2 femtocoulombs per micron in embodiments thereof as determined by the known charge spectrograph. Admix time for the toners of the present invention are preferably from about 5 seconds to 1 minute, and more specifically from about 5 to about 15 seconds in embodiments thereof as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions of the present invention in embodiments thereof possess desirable narrow charge distributions, optimal charging triboelectric values, preferably of from 10 to about 40, and more preferably from about 10 to about 35 microcoulombs per gram with from about 0.1 to about 1 weight percent in embodiments of the charge enhancing additive; and rapid admix charging times as determined in the charge spectrograph of less than 15 seconds, and more preferably in some embodiments from about 1 to about 14 seconds.

When the charge additives of the present invention are utilized in admixtures with other additives, for example alkyl pyridinium halides, organic sulfates, organic sulfonates, the bisulfates illustrated in the copending applications mentioned herein, distearyl dimethyl ammonium methyl sulfate, and the like, generally there is present in the mixture an effective amount of each additive, such as for example from about 0.05 to about 90 percent by weight of the first additive of the present invention, and from about 10 to about 99.5 weight percent of the second charge additive in an embodiment of the present invention; and from about 40 to about 60 percent by weight of the first additive of the present invention, and from about 60 to about 40 weight percent of the second charge additive in another embodiment of the present invention.

The following Examples are being supplied to further define various species of the present invention, it being noted that these Examples are intended to illustrate and not limit the scope of the present invention. Parts and percentages are by weight unless otherwise indicated.

EXAMPLE I

DENDRIMER AS INTERNAL CCA

There was prepared in an extrusion device, available as CSI MAX a toner composition by adding thereto 89.9 weight percent by weight of SPAR II TM resin particles, 10 percent by weight of PV-FAST BLUE TM, available from Hoechst, and 0.1 percent by weight of the charge enhancing additive, the sodium carboxylate terminated STARBURST TM dendrimer of the second generation, obtained from the Michigan Molecular Institute. The toner product attained a melting temperature of 410° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a positive triboelectric charge of 15 microcoulombs per gram.

There was then added to the above prepared developer composition 1 part by weight of an uncharged toner comprised of 89.9 percent by weight of suspension polymerized styrene butadiene copolymer resin particles (87/13), reference U.S. Pat. No. 4,558,108, the disclosure of which is totally incorporated herein by reference; 10 percent by weight of REGAL 330® carbon black; and 0.1 percent by weight of the above second generation dendrimer as a charge enhancing additive. Thereafter, the charge distribution of the resulting developer was measured as a function of the mixing time, and it was determined by a charge spectrograph that the admixing time was less than 60 seconds for this added uncharged toner.

EXAMPLE II

A toner and developer were prepared by repeating the procedure of Example I except that 5 weight percent of flushed HELIOGEN BLUE TM (obtained from BASF) was used in place of the carbon black, and the toner resin was comprised of 94.9 weight percent of an isobutyl methacrylate, n-lauryl methacrylate, and styrene, and there resulted a cyan toner with a triboelectrical charge of 9.8 microcoulombs per gram.

COMPARATIVE EXAMPLE III

A 6.8 micron (volume average particle diameter) cyan toner without a dendrimer charge enhancing additive was prepared as follows.

A mixture of 120 grams of styrene, 40 grams of n-butyl methacrylate, 25 grams of n-lauryl methacrylate and 4.0 grams of HELIOGEN BLUE K7090 TM pigment (available from BASF) was ball milled for 24 hours. To this mixture were added 3.0 grams each of two free radical initiators, 2,2'-azobis-(2,4-dimethylvaleronitrile) and 2,2'-azobis(isobutyronitrile), and the mixture was roll blended until all the free radical initiators were dissolved. An amount of 150 grams of the resulting mixture was then transferred to a 2 liter reaction vessel containing 700 milliliters of a 1.0 percent aqueous solution of TYLOSE® available from Fluka Chemicals Company, and the resulting mixture was homogenized for 2 minutes using a Brinkmann Polytron operating at 10,000 rpm. Thereafter, the mixture was stirred mechanically at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product evidenced a volume average particle diameter of 6.8 microns, and a particle size distribution of 1.31 according to Coulter Counter measurements.

A charged developer was prepared by blending 3 parts by weight of the above toner particles with 97 parts by weight of carrier particles comprised of a steel core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of 43.4 microcoulombs per gram as determined in the known Faraday Cage apparatus. Also, it is believed that excellent images can be generated with the aforementioned developer, which images would possess acceptable resolution characteristics when the latent images are initially formed in a xerographic experimental imaging device similar to the Xerox Corporation 9200, and subsequent to the development of images with the aforementioned prepared toner the images can be transferred to a paper substrate and fixed with heat, about 160° C., with a Viton fuser roll.

EXAMPLE IV

A 6.8 micron (volume average particle diameter) cyan toner with 0.05 percent of a dendrimer charge enhancing additive was prepared as follows.

A mixture of 120 grams of styrene, 40 grams of n-butyl methacrylate, 25 grams, of n-lauryl methacrylate and 4.0 grams of HELIOGEN BLUE K7090 TM pigment (available from BASF) was ball milled for 24 hours. To this mixture were added 3.0 grams each of two free radical initiators, 2,2'-azobis-(2,4-dimethylvaleronitrile) and 2,2'-azobis(isobutyronitrile), and the mixture was roll blended until all the free radical initiators were dissolved. An amount of 150 grams of the resulting mixture was then transferred to a 2 liter reaction vessel containing 700 milliliters of a 1.0 percent aqueous solution of TYLOSE ® available from Fluka Chemicals Company, and the resulting mixture was homogenized for 2 minutes using a Brinkmann Polytron operating at 10,000 rpm. Thereafter, the mixture was stirred mechanically at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and 95 milligrams of a sodium carboxylate terminated dendrimer of the third generation obtained from the Michigan Molecular Institute (0.05 percent by weight of toner) was added to the toner slurry. The resulting mixture was stirred magnetically at room temperature for 30 minutes, after which time the product was isolated by freeze drying for 48 hours. The resulting toner particle product evidenced a volume average particle diameter of 6.8 microns, and a particle size distribution of 1.31 according to Coulter Counter measurements.

A charged developer was prepared by blending 3 parts by weight of the above toner particles with 97 parts by weight of carrier particles comprised of a steel core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of 10.2 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200, and subsequent to the development of images with the aforementioned prepared toner the images can be transferred to a paper substrate and fixed with heat, about 160° C., with a Viton fuser roll.

EXAMPLE V

A 6.8 micron (volume average particle diameter) cyan toner with 0.5 percent of a dendrimer charge enhancing additive was prepared as follows.

A mixture of 120 grams of styrene, 40 grams of n-butyl methacrylate, 25 grams of n-lauryl methacrylate and 4.0 grams of HELIOGEN BLUE K7090 TM pigment (available from BASF) was ball milled for 24 hours. To this mixture were added 3.0 grams each of two free radical initiators, 2,2'-azobis-(2,4-dimethylvaleronitrile) and 2,2'-azobis(isobutyronitrile), and the mixture was roll blended until all the free radical initiators were dissolved. An amount of 150 grams of the resulting mixture was then transferred to a 2 liter reaction vessel containing 700 milliliters of a 1.0 percent aqueous solution of TYLOSE ® available from Fluka Chemicals Company, and the resulting mixture was homogenized for 2 minutes using a Brinkmann Polytron operating at 10,000 rpm. Thereafter, the mixture was stirred mechanically at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and 950 milligrams of a sodium carboxylate terminated dendrimer of the third generation obtained from the Michigan Molecular Institute (0.5 percent by weight of toner) was added to the toner slurry. The resulting mixture was stirred magnetically at room temperature for 30 minutes, after which time the product was isolated by freeze drying for 48 hours. The resulting toner particle product evidenced a volume average particle diameter of 6.8 microns, and a particle size distribution of 1.31 according to Coulter Counter measurements.

A charged developer was prepared by blending 3 parts by weight of the above toner particles with 97 parts by weight of carrier particles comprised of a steel core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of −11.1 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200, and subsequent to the development of images with the aforementioned prepared toner the images can be transferred to a paper substrate and fixed with heat, about 160° C., with a Viton fuser roll.

EXAMPLE VI

A 6.8 micron (volume average particle diameter) cyan toner with 0.1 percent of 310-93D dendrimer charge enhancing additive was prepared as follows.

A mixture of 120 grams of styrene, 40 grams of n-butyl methacrylate, 25 grams of n-lauryl methacrylate and 4.0 grams of HELIOGEN BLUE K7090 TM pigment (available from BASF) was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. An amount of 150 grams of the resulting mixture was then transferred to a 2 liter reaction vessel containing 700 milliliters of a 1.0 percent aqueous solution of TYLOSE ® available from Fluka Chemicals Company, and the resulting mixture was homogenized for 2 minutes using a Brinkmann Polytron operating at 10,000 rpm. Thereafter, the mixture was stirred mechanically at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and 189 milligrams of a sodium carboxylate terminated dendrimer of the second generation obtained from the Michigan Molecular Institute was added to the toner slurry. The resulting mixture was stirred magnetically at room temperature for 30 minutes, after which time the product was isolated by freeze drying for 48 hours. The resulting toner particle product evidenced a volume average particle diameter of 6.8 microns, and a particle size distribution of 1.31 according to Coulter Counter measurements.

A charged developer was prepared by blending 3 parts by weight of the above toner particles with 97 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of 5.7 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200, and subsequent to the development of images with the aforementioned prepared toner the images can be transferred to a paper substrate and fixed with heat, about 160° C., with a Viton fuser roll.

EXAMPLE VII

A 6.8 micron (volume average particle diameter) cyan toner with 0.1 percent of a dendrimer charge enhancing additive was prepared as follows.

A mixture of 120 grams of styrene, 40 grams of n-butyl methacrylate, 25 grams of n-lauryl methacrylate and 4.0 grams of HELIOGEN BLUE K7090 TM pigment (available from BASF) was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. An amount of 150 grams of the resulting mixture was then transferred to a 2 liter reaction vessel containing 700 milliliters of a 1.0 percent aqueous solution of TYLOSE ® available from Fluka Chemicals Company, and the resulting mixture was homogenized for 2 minutes using a Brinkmann Polytron operating at 10,000 rpm. Thereafter, the mixture was stirred mechanically at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear, and 189 milligrams of a sodium carboxylate terminated dendrimer of the fifth generation obtained from the Michigan Molecular Institute was added to the toner slurry. The resulting mixture was stirred magnetically at room temperature for 30 minutes after which time the product was isolated by freeze drying for 48 hours. The resulting toner particle product evidenced a volume average particle diameter of 6.8 microns, and a particle size distribution of 1.31 according to Coulter Counter measurements.

A charged developer was prepared by blending 3 parts by weight of the above toner particles with 97 parts by weight of carrier particles comprised of a steel core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of 5.4 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200, and subsequent to the development of images with the aforementioned prepared toner the images can be transferred to a paper substrate and fixed with heat, about 160° C., with a Viton fuser roll.

EXAMPLE VIII

TONER WITH AMINO-TERMINATED DENDRIMER

A mixture of 120 grams of styrene, 40 grams of n-butyl methacrylate, 25 grams of n-lauryl methacrylate and 4.0 grams of HELIOGEN BLUE K7090 TM pigment (available from BASF) was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. An amount of 150 grams of the resulting mixture was then transferred to a 2 liter reaction vessel containing 700 milliliters of a 1.0 percent aqueous solution of TYLOSE ® available from Fluka Chemicals Company, and the resulting mixture was homogenized for 2 minutes using a Brinkmann Polytron operating at 10,000 rpm. Thereafter, the mixture was stirred mechanically at room temperature, 25° C., for 30 minutes before heating to 80° C. over a period of 1 hour, and maintained at this temperature for another 10 hours. After cooling down to room temperature, the reaction product was washed repeatedly with water until the aqueous phase was clear. To the 12.5 grams of the toner were added 190 milligrams of an amino-terminated dendrimer of the first generation obtained from the Michigan Molecular Institute. The resulting mixture was sonicated at room temperature for 10 minutes, after which time the product was isolated by freeze drying for 48 hours. The resulting toner particle product evidenced a volume average particle diameter of 6.8 microns, and a particle size distribution of 1.31 according to Coulter Counter measurements.

A charged developer was prepared by blending 3 parts by weight of the above toner particles with 97 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner displayed a triboelectric value of about 14 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200, and subsequent to the development of images with the aforementioned prepared toner the images can be transferred to a paper substrate and fixed with heat, about 160° C., with a Viton fuser roll.

EXAMPLE IX

A 7 micron toner composition comprised of a polyester resin, pigment and without a dendrimer charge enhancing additive was prepared as follows.

There was prepared in an extrusion device, available as CSI MAX melt mixing from Custom Scientific Instrumentation Incorporated, a toner composition by adding thereto by weight of toner 98 weight percent of polyester resin derived from propoxylated bisphenol A and fumaric acid (available from Ashland Chemicals as SPAR II TM) and 2 weight percent of PV FAST BLUE TM pigment (available from Hoechst Chemicals). The toner product, which was extruded at a barrel temperature of 150° C., a rotor temperature of 150° C. and rotor speed of 30 revolutions per minute, was ground in a coffee mill (available from Black & Decker as a Coffee Bean Grinder) for 3 minutes and the corresponding coarse particles sieved through a 250 micron screen. The coarse particles were then subjected to micronization utilizing a Trost GEM Air Impact Pulverizer TM (available from Garlok Plastomer Products) enabling particles with a volume median diameter of 7 microns as measured by a Coulter Counter.

Subsequently, the above formulated toner, 3 parts by weight, was mixed with 97 parts by weight of a carrier containing a steel core with a polymer mixture thereof, 0.70 percent by weight, which polymer mixture contained 40 parts by weight of polyvinylidene fluoride, and 60 parts by weight of polymethyl methacrylate, and wherein mixing was accomplished by roll milling for 30 minutes. There resulted a developer composition with a triboelectric charge of −14 microcoulombs per gram, as determined in the known Faraday Cage apparatus.

There was then added to the above prepared developer composition 1 part by weight of uncharged toner of this Example. Thereafter, the charge distribution of the resulting developer was measured as a function of the mixing time, and it was determined by a charge spectrograph that the admixing time was greater than 5 minutes.

EXAMPLE X

A 7 micron toner composition comprised of a polyester resin, pigment and with a dendrimer charge enhancing additive was prepared as follows.

There was prepared in an extrusion device, available as CSI MAX melt mixing from Custom Scientific Instrumentation Incorporated, a toner composition by adding thereto 96 weight percent of polyester resin derived from propoxylated bisphenol A and fumaric acid (available from Ashland Chemicals as SPAR II TM); 2 weight percent of PV FAST BLUE TM pigment (available from Hoechst Chemicals); and 2 weight percent of carboxy-terminated STARBURST TM dendrimer of the first generation, obtained from the Michigan Molecular Institute. The toner product which was extruded at a barrel temperature of 150° C., a rotor temperature of 150° C. and rotor speed of 30 revolutions per minute, was ground in a coffee mill (available from Black & Decker as a Coffee Bean Grinder) for 3 minutes and the corresponding coarse particles sieved through a 250 micron screen. The coarse particles were then subjected to micronization utilizing a Trost GEM Air Impact Pulverizer TM (available from Garlok Plastomer Products) enabling particles with a volume median diameter of 6.5 microns as measured by a Coulter Counter.

Subsequently, the above formulated toner, 3 parts by weight, was mixed with 97 parts by weight of a carrier containing a steel core with a polymer mixture thereof, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a triboelectric charge of −18 microcoulombs per gram.

There was then added to the above prepared developer composition 1 part by weight of uncharged toner of this Example. Thereafter, the charge distribution of the resulting developer was measured as a function of the mixing time, and it was determined by a charge spectrograph that the admixing time was 30 seconds for this added uncharged toner.

Other modifications of the present invention may occur to those skilled in the art subsequent to a review of the present application, and these modifications, including equivalents thereof, are intended to be included within the scope of the present invention.

What is claimed is:

1. An encapsulated toner composition comprised of a core comprised of a resin and pigment particles, and a polymer shell, and thereover coated with a dendrimer charge enhancing additive.

2. A toner composition in accordance with claim 1 wherein the charge additive is present in an amount of from about 0.05 to about 1 weight percent.

3. An in situ toner composition comprised of a core comprised of a resin and pigment particles, and a surfactant coating, and thereover a coating of a dendrimer charge enhancing additive.

4. A toner composition in accordance with claim 3 wherein the charge additive is present in an amount of from about 0.05 to about 1 weight percent.

* * * * *